US009307613B2

(12) United States Patent
Salvestrini

(10) Patent No.: US 9,307,613 B2
(45) Date of Patent: Apr. 5, 2016

(54) LOAD CONTROL DEVICE WITH AN ADJUSTABLE CONTROL CURVE

(71) Applicant: Lutron Electronics Co., Inc., Coopersburg, PA (US)

(72) Inventor: Christopher J. Salvestrini, Allentown, PA (US)

(73) Assignee: LUTRON ELECTRONICS CO., INC., Coopersburg, PA (US)

( * ) Notice: Subject to any disclaimer, the term of this patent is extended or adjusted under 35 U.S.C. 154(b) by 300 days.

(21) Appl. No.: 13/792,902

(22) Filed: Mar. 11, 2013

(65) Prior Publication Data

US 2014/0252980 A1 Sep. 11, 2014

(51) Int. Cl.
*H05B 37/02* (2006.01)

(52) U.S. Cl.
CPC ..... *H05B 37/02* (2013.01)

(58) Field of Classification Search
CPC ..... H05B 37/02; H05B 33/0815; H05B 33/0845; H05B 41/36; H05B 41/38; H05B 41/3921; H05B 41/3924
USPC ..... 315/209 R, 246, 287, 291, 294, 297, 315/307, 308, 312
See application file for complete search history.

(56) References Cited

U.S. PATENT DOCUMENTS 3,684,919 A 8/1972 Cramer
3,816,797 A 6/1974 Skirpan
4,219,761 A 8/1980 Mustoe
4,408,142 A 10/1983 Wilje
4,527,099 A 7/1985 Capewell et al.
5,128,594 A 7/1992 Watanabe et al.
5,357,170 A * 10/1994 Luchaco et al. ..... 315/159
5,430,356 A * 7/1995 Ference et al. ..... 315/291
5,929,568 A 7/1999 Eggers
6,538,395 B2 3/2003 Szabados
6,683,419 B2 1/2004 Kriparos
6,737,814 B2 5/2004 Guthrie et al.
6,761,470 B2 7/2004 Sid
6,771,029 B2 8/2004 Ribarich et al.
6,975,079 B2 * 12/2005 Lys et al. ..... 315/292
7,462,995 B2 12/2008 Hamidian et al.
7,471,051 B1 12/2008 Wacknov et al.
7,667,408 B2 2/2010 Melanson et al.
8,242,714 B2 8/2012 Weightman et al.
2004/0196140 A1 10/2004 Sid
2006/0220571 A1 10/2006 Howell et al.
2006/0274540 A1 12/2006 Klaver et al.
2007/0120507 A1 5/2007 Uchida et al.
2008/0106218 A1 5/2008 Zulch
2008/0111500 A1 5/2008 Hoover
2008/0215279 A1 9/2008 Salsbury et al.
(Continued)

*Primary Examiner* — Thai Pham
(74) *Attorney, Agent, or Firm* — Condo Roccia Koptiw LLP

(57) ABSTRACT

A load control device, such as a dimmer switch, for example, may provide for user adjustment of the shape of a control curve, such as a dimming curve, for example. The load control device may generate a control curve that has a non-linear relationship between a minimum power level, such as a minimum phase angle of a phase-control signal, for example, and a maximum power level, such as a maximum phase angle of the phase-control signal, for example. The load control device switch may have a default control curve, which may have a linear relationship between the minimum power level and the maximum power level. The load control device may provide for the generation of a control curve that includes two or more different slopes from the minimum power level to the maximum power level.

54 Claims, 6 Drawing Sheets

(56) References Cited

U.S. PATENT DOCUMENTS

| | | | | |
|---|---|---|---|---|
| 2008/0224635 | A1 | 9/2008 | Hayes | |
| 2008/0238343 | A1 | 10/2008 | Hargenrader et al. | |
| 2008/0297065 | A1 | 12/2008 | Mubaslat et al. | |
| 2009/0079360 | A1 | 3/2009 | Shteynberg et al. | |
| 2009/0167207 | A1 | 7/2009 | Zimmermann et al. | |
| 2009/0256483 | A1* | 10/2009 | Gehman et al. | 315/129 |
| 2011/0121752 | A1 | 5/2011 | Newman, Jr. et al. | |
| 2011/0121812 | A1 | 5/2011 | Salvestrini | |
| 2012/0033471 | A1 | 2/2012 | Newman, Jr. | |
| 2012/0230073 | A1 | 9/2012 | Newman, Jr. et al. | |

* cited by examiner

LOAD CONTROL DEVICE WITH AN ADJUSTABLE CONTROL CURVE

BACKGROUND

A dimmer switch may use one or more semiconductor switches, for example, triacs or field effect transistors (FETs) to control the amount of power delivered to a lighting load, for example, an incandescent lamp, screw-in compact fluorescent lamp (CFL), or light-emitting diode (LED) lamp. For example, the dimmer switch may control the amount of power delivered to the lighting load by controlling the phase angle P of a phase-control signal provided to the lighting load. The dimmer switch may be operable to control the phase angle P of the phase-control signal provided to the lighting load across a dimming range from a minimum phase angle $P_{MIN}$ (e.g., approximately 5°) to a maximum phase angle $P_{MAX}$ (e.g., approximately 175°), for example, in response to actuations of an intensity adjustment actuator, which may be, for example, a slider control or a rocker switch.

In a typical prior art dimmer switch, the phase angle P of the dimmer switch may be varied linearly with respect to a user-selected (or controlled) lighting intensity N, for example, as shown in FIG. 1. The controlled lighting intensity N may be varied between a minimum controlled lighting intensity $N_{MIN}$ and a maximum controlled lighting intensity $N_{MAX}$. For example, the controlled lighting intensity N may represent the "position" of an intensity actuator (e.g., a slider control) of a dimmer switch. The relationship between the phase angle P of the phase-control signal provided to the lighting load and the controlled lighting intensity N may be referred to as a dimming curve. Some prior art dimmer switches may allow a user to linearly adjust the minimum and maximum phase angles $P_{MIN}$, $P_{MAX}$. When the minimum and maximum phase angles $P_{MIN}$, $P_{MAX}$ are adjusted, the dimmer switch may linearly rescale the dimming curve between the newly-selected minimum and maximum phase angles $P_{MIN}'$, $P_{MAX}'$ to create an adjusted dimming curve, for example, as shown in FIG. 1. For example, a prior art dimming switch may allow for the adjustment of an initial dimming curve 110, which allows for the linear adjustment between minimum and maximum phase angles $P_{MIN}$, $P_{MAX}$, to an adjusted dimming curve 120, which allows for the linear adjustment between a minimum and maximum phase angles $P_{MIN}'$, $P_{MAX}'$. However, both the default dimming curve 100 and the adjusted dimming curve 120 provide a linear interpolation between the minimum and maximum phase angles.

However, it may be preferable to control some new load types, such as LED lamp loads, across dimming curves that are not a linear interpolation between the minimum and maximum phase angles $P_{MIN}$, $P_{MAX}$. Therefore, there is a need for a lighting control device that allows for user adjustment of the shape of the dimming curve in a non-linear manner.

SUMMARY

As disclosed herein, a load control device, such as a dimmer switch, for example, may provide for user adjustment of the shape of a control curve (e.g., dimming curve). The load control device may generate a control curve that has a non-linear relationship between a minimum power level (e.g., minimum phase angle) and a maximum power level (e.g., maximum phase angle). For example, the load control device switch may have a default control curve, which may have a linear relationship between the minimum power level and the maximum power level, for example. The load control device may provide for the generation of a control curve that includes two or more different slopes from the minimum power level to the maximum power level.

The load control device may control an amount of power delivered from an alternating current (AC) power source to an electrical load. The load control device may include a controllably conductive device that may be operable to control the amount of power delivered from the AC power source to the electrical load. The load control device may include a controller that may be operable to render the controllably conductive device conductive for at least a portion of a half-cycle of an AC line voltage from the AC power source in accordance with a first control curve and in accordance with a second control curve. The second control curve may include a first portion having a first slope and a second portion having a second slope, whereby the first slope may be different from the second slope.

The controller may be operable to generate a second control curve by adjusting a phase angle of a phase-control signal at a first controlled power level from a first phase angle associated with a first control curve to a second phase angle. The second control curve may include a first portion having a first slope and a second portion having a second slope, the first slope being different from the second slope.

The load control device may include a power adjustment actuator (e.g., an intensity adjustment actuator) for setting a controlled power level (e.g., a control lighting intensity). The dimmer switch may also include a controller operably coupled to the power adjustment actuator. The controller may adjust phase angles of a phase-control signal associated with the controlled power levels of the power adjustment actuator to generate a control curve that has a non-linear relationship between a minimum power level and a maximum power level. Similarly, the controlled may adjust the controlled power levels of the power adjustment actuator associated with the phase angles of the phase-control signal to generate a control curve that has a non-linear relationship between a minimum power level and a maximum power level.

A load control device (e.g., a lighting control device) may have a user-adjustable dimming curve shape. For example, a lighting control device having a user-adjustable dimming curve shape may comprise one or more of the following: (1) a controllably conductive device (e.g., a bidirectional semiconductor switch) that may be configured to control the amount of power delivered to a lighting load via a phase-control signal, the phase-control signal ranging from a minimum phase angle to a maximum phase angle; (2) a power adjustment actuator (e.g., intensity adjustment actuator) that may be configured to be actuated by a user for selecting a controlled lighting intensity; (3) a controller operably coupled to the controllably conductive device and the power adjustment actuator, for example, such that the controller may be configured to adjust the phase angle of the phase-control signal in response to a controlled lighting intensity determined by an intensity adjustment actuator, for example, as defined by a dimming curve; and (4) a user input means operably coupled to a controller. The user input means may be configured to change the relationship between the phase angle of the phase-control signal and the controlled lighting intensity as defined by the dimming curve, for example, such that the rate of change of the phase angle of the phase-control signal with respect to the controlling lighting intensity is not constant at all points along the dimming curve.

DETAILED DESCRIPTION

A detailed description of illustrative embodiments will now be described with reference to the various Figures. Although this description provides a detailed example of possible implementations, it should be noted that the details are intended to be exemplary and in no way limit the scope of the application.

Figure 1:
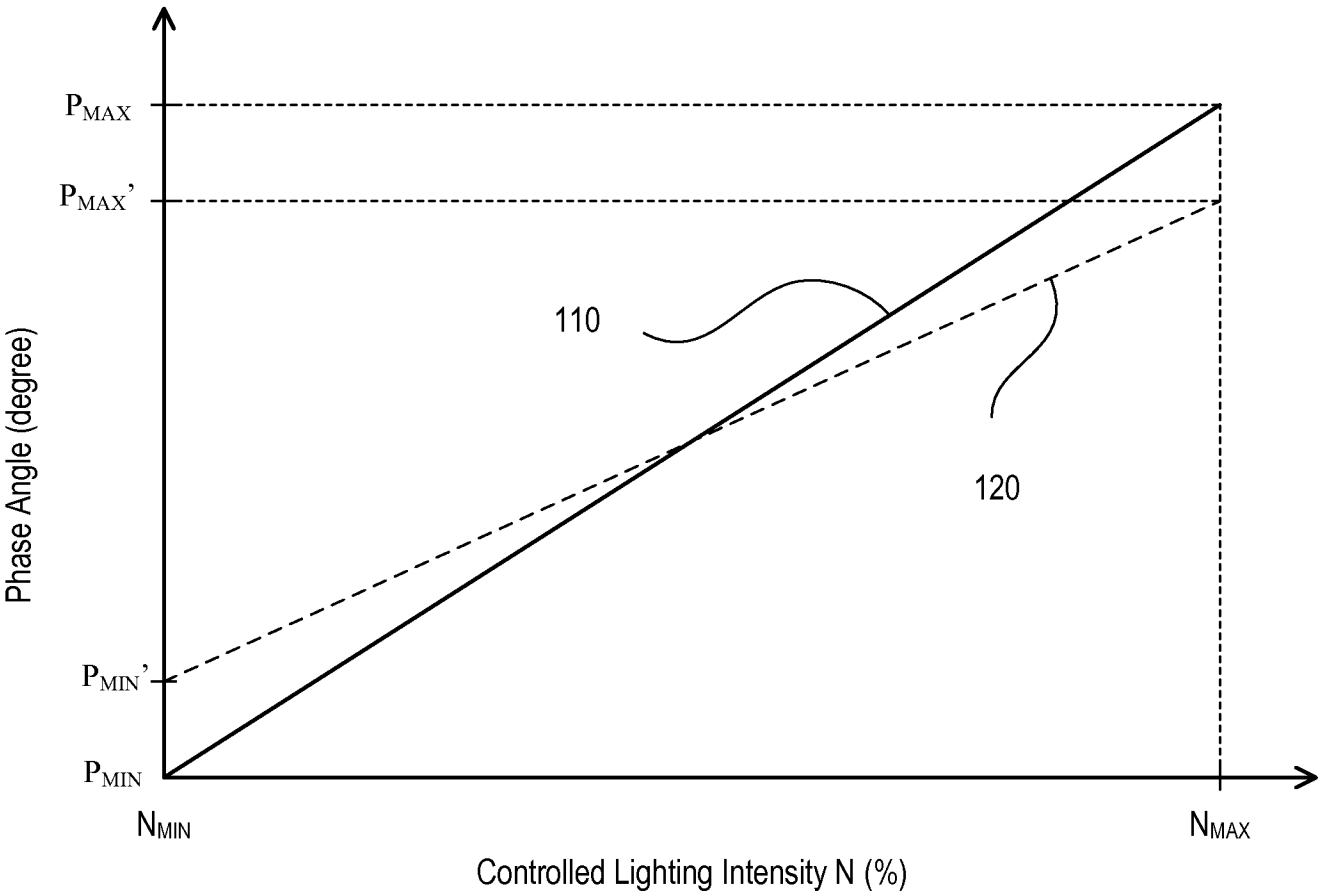
FIG. 1 is an example dimming curve of a phase angle of a phase-control signal with respect to the controlled lighting intensity of a prior art dimmer switch.
Figure 2:
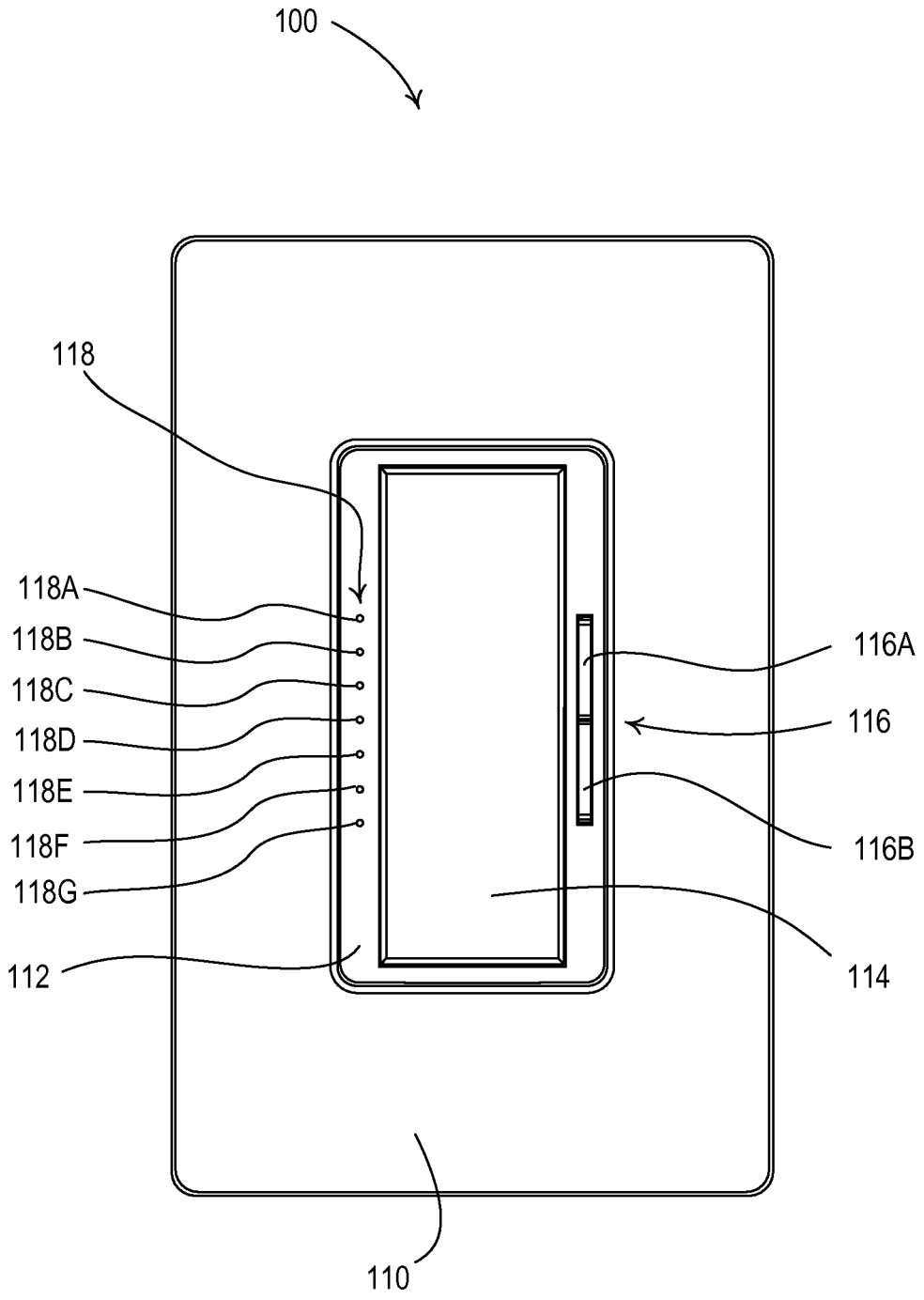
FIG. 2 is a front view of an example dimmer switch that provides a user-adjustable dimming curve shape.

FIG. 2 is a front view of an example dimmer switch 100 (e.g., a "smart" dimmer switch) that may provide a user-adjustable dimming curve shape. The dimmer switch 100 may be configured to be coupled in series electrical connection between an AC power source (e.g., AC power source 202 of FIG. 3) and an electrical load (e.g., lighting load 204 of FIG. 3). For example, the lighting load 204 may be an LED lamp load. The dimmer switch 110 may control the amount of power delivered to the lighting load. The dimmer switch 100 may comprise a faceplate 110, a bezel 112 received in an opening of the faceplate 110, a control actuator 114 (e.g., a toggle actuator), and a power adjustment actuator 116 (e.g., an intensity adjustment actuator). The power adjustment actuator 116 may be a rocker switch, for example, as shown in FIG. 2. Actuations of the control actuator 114 may toggle (e.g., alternately turn off and on) the lighting load.

Figure 4:
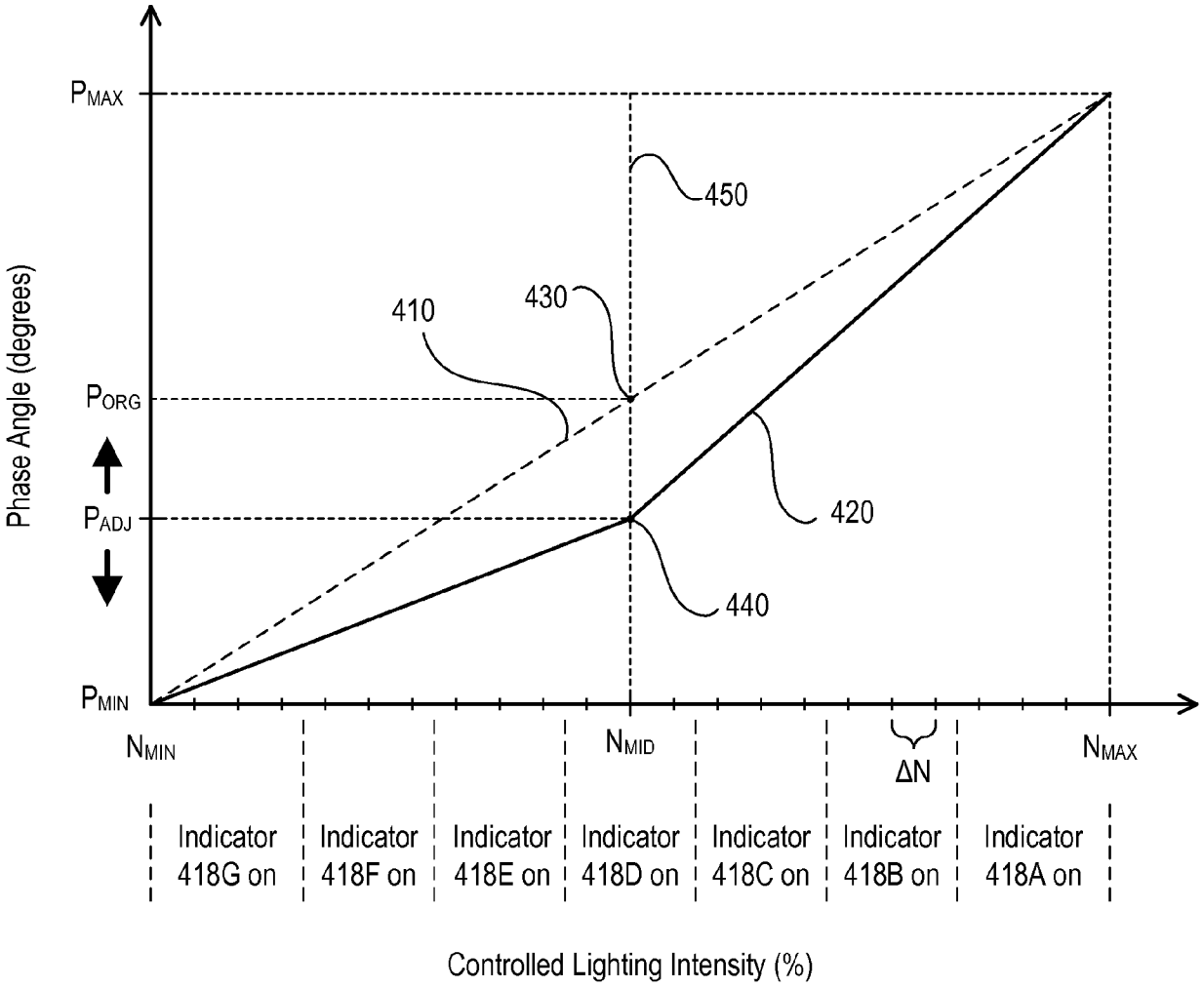
FIG. 4 is an example dimming curve of a phase angle of a phase-control signal with respect to a controlled lighting intensity of a dimmer switch.

A single actuation of an upper portion 116A or a lower portion 116B of the power adjustment actuator 116 may increase or decrease, respectively, the controlled lighting intensity N of the lighting load, for example, by a predetermined increment ΔN. The dimmer switch 100 may adjust a phase angle P of a phase-control signal in response to the controlled lighting intensity N, for example, as defined by a dimming curve of the dimmer switch. A linear array 118 of visual indicators 118A-118G (e.g., light emitting diodes (LEDs)) may be arranged along the side (e.g., the left side) of the bezel 112. The visual indicators 118A-118G may be illuminated to provide feedback of the phase angle of the phase-control signal (e.g., which may correspond to an actual intensity of the lighting load). For example, one of the plurality of visual indicators 118, for example, that may be representative of the controlled lighting intensity N, may be illuminated constantly (e.g., as shown in FIG. 4).

Figure 3:
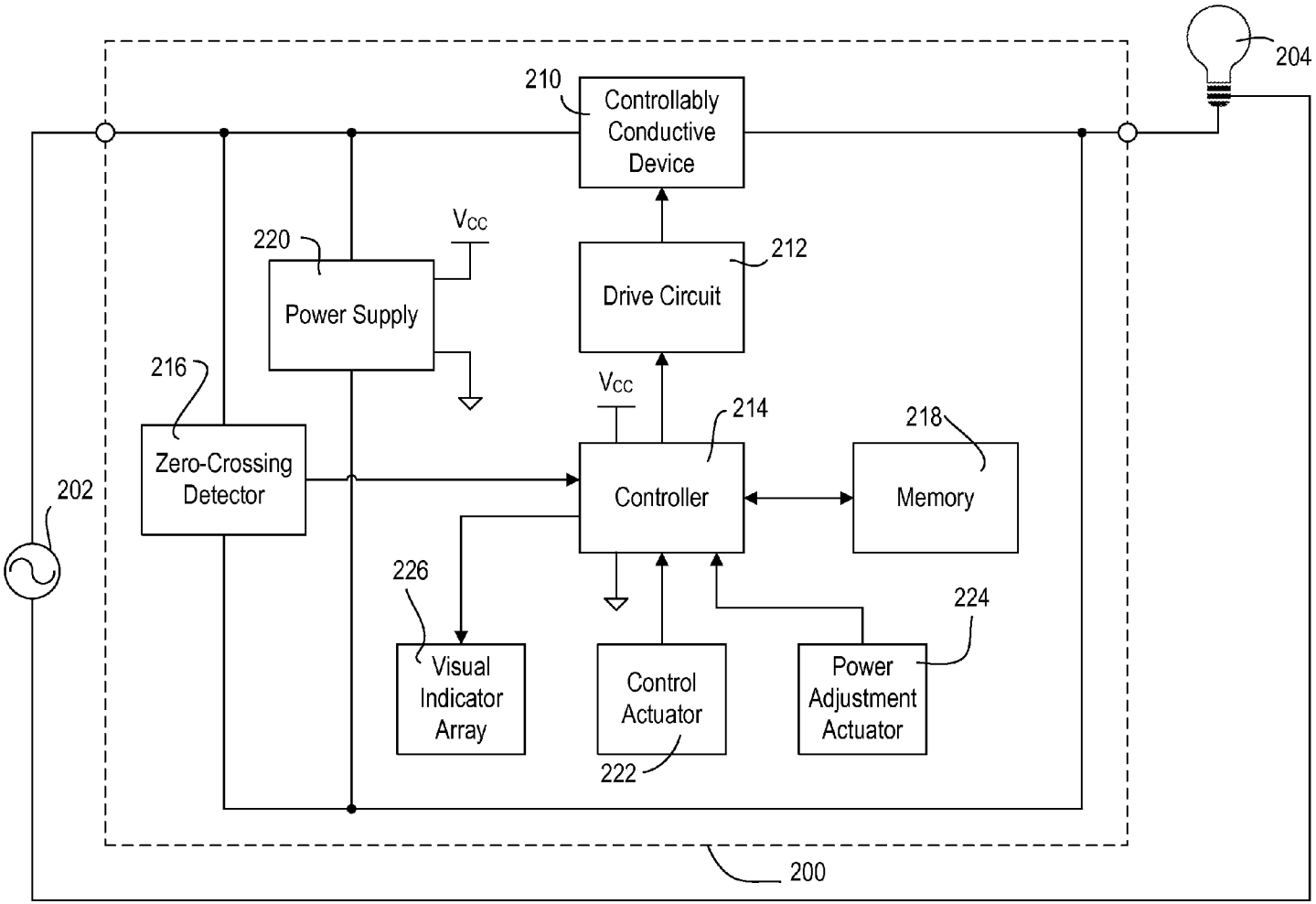
FIG. 3 is a simplified block diagram of an example of a load control device.

FIG. 3 is a simplified block diagram of an example load control device 200. The load control device 200 (e.g., the dimmer switch 100 shown in FIG. 2) may comprise a controllably conductive device 210, a drive circuit 212, a controller 214 (e.g., a microprocessor), a zero-cross detector 216, a memory 218, a power supply 220, a control actuator 222, a power adjustment actuator 224 (e.g., an intensity adjustment actuator), and a visual indicator array 226. The load control device 200 may be a dimmer switch, such as an electronic dimmer switch, for example. The controllably conductive device 210 may be a bidirectional semiconductor switch, such as but not limited to a triac or two field-effect transistors (FETS) in anti-series connection, for example. The controllably conductive device 210 may be operably coupled in series electrical connection between an AC power source 202 and a load 204, for example, to control of the power delivered to the load 204.

The controller 214 may be operably coupled to the controllably conductive device 210, for example, via a drive circuit 212. The controller 214 may be configured to render the controllably conductive device 210 conductive for a portion of each half-cycle of the AC line voltage from the AC power source 202, which, for example, may control the amount of power delivered to the load 204 via a phase-control signal. The phase-control signal may be representative of the potions of the AC line voltage from the AC power source 202 that are delivered to the load 204. The phase-control signal may be characterized by a phase angle (e.g., a firing angle). The phase angle of the phase-control signal may be representative of the amount of power delivered to the load 204. For example, the phase angle may relate to a position of each half-cycle of the AC line voltage that the controller 214 renders the controllably conductive device 210 conductive.

The controller 214 may be configured to control the controllably conductive device 210 in response to the zero-crossing detector 216. The zero-crossing detector 216 may be configured to determine the zero-crossings of the input AC line voltage from the AC power supply 202. The controller 214 may be configured to receive input from the control actuator 222 and/or the power adjustment actuator 224.

The controller 214 may be configured to control the visual indicator array 226, which for example, may be similar to the linear array 118 of visual indicators 118A-118G as shown in FIG. 2. The controller 214 may be operably coupled to the memory 218 for storage of, for example, the minimum phase angle $P_{MIN}$, the maximum phase angle $P_{MAX}$, the current phase angle, the minimum lighting intensity $L_{MIN}$, the maximum lighting intensity $L_{MAX}$, dimming curve information, and other operational characteristics of the load control device 200. A power supply 220 may generate a direct-current (DC) voltage VCC for powering the controller 214, the memory 218, and other low voltage circuitry of the load control device 200.

The load control device 200 may be configured to adjust the phase angle P of the load control device 200 in response to the controlled lighting intensity N as defined by the dimming curve. The relationship between the phase angle P and the controlled lighting intensity N (e.g., the dimming curve) may be adjusted by a user. The load control device 200 may provide the user with an advanced programming mode, in which the user interface (e.g., the control actuator 114/222, the power adjustment actuator 116/224, and the visual indicators 118/226) may be used to adjust the shape of the dimming curve. An example of the advanced programming mode is described in U.S. Pat. No. 7,190,125, issued Mar. 13, 2007, which is incorporated by reference herein.

There may be a relationship between the phase angle P of the phase-control signal delivered to the load (e.g., lighting load) and the output (e.g., light output or actual lighting intensity) of the load. For example, the relationship between the phase angle P of the phase-control signal delivered to an incandescent lamp and the light output of the incandescent lamp may be substantially similar for substantially all incandescent lamps. However, that may not be the case with other load types, such as screw-in CFLs and LED lamps, for example. This may be due to the fact that screw-in CFLs and LED lamps may comprise a controller (e.g., a microprocessor) that utilizes one of a plurality of different characteristics of the phase-control signal provided to the lamp to determine the light output of the lamp. This may lead to the midpoint of the controlled lighting intensity N of some dimmer switches not corresponding with the midpoint of the light output of some loads (e.g., some screw-in CFL and LED lamps).

The adjustment of a control curve (e.g., a dimming curve) may allow for a user to uniquely define how they would like to control their lamp over the controlled lighting intensity range (e.g., from $N_{MIN}$ to $N_{MAX}$). For example, the adjustment of a control curve (e.g., a dimming curve) may allow for a user to set the midpoint of the controlled lighting intensity N to be approximately at the midpoint of the light out (e.g., the actual lighting intensity) of the load, for example, regardless of what characteristic of the phase-control signal the load utilizes to determine light output of the lamp.

FIG. 4 is an example dimming curve of a phase angle P of a phase-control signal with respect to a controlled lighting intensity N of a dimmer switch (e.g., dimmer switch 100, load control device 200, etc.). A phase angle P of the phase-control signal may be adjusted between a minimum phase angle $P_{MIN}$ and a maximum phase angle $P_{MAX}$. For example, the minimum phase angle $P_{MIN}$ may be approximately 0° (e.g., approximately 5°, 10°, etc.) and a maximum phase angle $P_{MAX}$ may be approximately 180° (e.g., approximately 175°, 170°, etc.).

An intensity adjustment actuator (e.g., power adjustment actuator 116/224) of the dimmer switch may adjust a controlled lighting intensity N between a minimum controlled lighting intensity $N_{MIN}$ and a maximum controlled lighting intensity $N_{MAX}$, for example, by predetermined increments ΔN. For example, a single actuation of an upper portion (e.g., upper portion 116A) or a lower portion (e.g., lower portion 116B) of the intensity adjustment actuator may increase or decrease, respectively, the controlled lighting intensity N of the lighting load by the predetermined increment ΔN. The intensity adjustment actuator may be operable to adjust the relationship between the controlled lighting intensity N and the phase angle P to adjust a dimming curve. The dimmer switch may comprise a control curve actuator that is operable to adjust the relationship between the controlled lighting intensity N and the phase angle P to adjust a dimming curve. The control curve actuator may be a physical device (e.g., a potentiometer) or software residing within the dimmer switch.

The controlled lighting intensity N may be representative of the position of the intensity adjustment actuator on the dimmer switch. For example, the intensity adjustment actuator may comprise an array of visual indicators 418A-418G (e.g., similar to 118A-118G as shown in FIG. 2) and the visual indicators 418A-418G may be illuminated in accordance with the position of the controlled lighting intensity N, for example, as shown in FIG. 4. For example, if the controlled lighting intensity is at the midpoint $N_{MID}$, then indicators 418G through 418D may be illuminated, while indicators 418A through 418C may not be illuminated. However, the dimmer switch may not comprise the array of visual indicators 418A through 418G.

A user may adjust a dimming curve (e.g., dimming curve 410) by raising or lowering the phase angle P of the phase-control signal provided to the lighting load corresponding with a specific magnitude of the controlled lighting intensity N (e.g., a control midpoint $N_{MID}$), for example, using an advanced programming mode. By adjusting the dimming curve (e.g. dimming curve 410), the dimmer switch may generate a new dimming curve (e.g., dimming curve 420). The user may adjust the phase angle P by actuating the intensity adjustment actuator or control curve actuator when in the advanced programming mode, for example. For example, the user may adjust the phase angle P of the phase-control signal from an original phase angle $P_{ORG}$, which may correspond with the control midpoint $N_{MID}$ according to a dimming curve 410, to any phase angle P between the minimum phase angle $P_{MIN}$ and the maximum phase angle $P_{MAX}$. The user may adjust the phase angle P by a predetermined angle (e.g., approximately 5°) at a time. This may be done without adjusting the controlled lighting intensity N. For example, as shown in FIG. 4, the user may define an adjusted phase angle $P_{ADJ}$ for the phase-control signal corresponding to the control midpoint $N_{MID}$ to be any phase angle along the vertical line 450.

After adjusting the phase angle P of the phase-control signal corresponding to the control midpoint $N_{MID}$, the user may define an inflection point (e.g., inflection point 440). When the user has finished the adjustment of the phase angle P of the phase control-signal, the user may exit the advanced programming mode. The dimmer switch may generate a resulting dimming curve 420 (e.g., an adjusted dimming curve or second dimming curve) using the adjusted phase angle $P_{ADJ}$ of the phase-control signal corresponding to the control midpoint $N_{MID}$ (e.g., using the defined inflection point 440).

The resulting dimming curve may be characterized by the inflection point (e.g., inflection point 440 in FIG. 4) defined by the selected phase angle $P_{ADJ}$ of the phase-control signal at the control midpoint $N_{MID}$. The dimmer switch, for example, a controller of the dimmer switch (e.g., controller 214), may generate an adjusted (or second) dimming curve using the defined inflection point. For example, the controller may scale (e.g., linearly scale) the dimming curve between the minimum phase angle $P_{MIN}$ and the adjusted phase angle $P_{ADJ}$ at the selected inflection point, and the controller may scale (e.g., linearly scale) the dimming curve between the adjusted phase angle $P_{ADJ}$ at the defined inflection point and the maximum phase angle $P_{MAX}$. Accordingly, the controller may control the phase angle P of the phase-control signal delivered to the lighting load in response to the controlled lighting intensity N according to a dimming curve characterized by the defined inflection point (e.g., dimming curve 420 characterized by inflection point 440).

Still referring to FIG. 4, the dimmer switch may comprise a first dimming curve 410, such as a default dimming curve, for example, of which may be stored in memory. The dimming switch may generate a second or adjusted dimming curve 420, for example, as described herein. After generation of the second dimming curve 420, the dimmer switch may store the second dimming curve 420 in memory. A user of the dimmer switch may generate the second dimming curve 420 by altering the shape of the first dimming curve 410. For example, a user may define an adjusted phase angle $P_{ADJ}$ of the phase-control signal delivered to the lighting load that corresponds with the control midpoint $N_{MID}$ of the controlled lighting intensity N, for example, via an advanced programming mode. The first dimming curve 410 may be characterized by an inflection point 430, which may be characterized by the original phase angle $P_{ORG}$ at the control midpoint $N_{MID}$. The user may define an adjusted phase angle $P_{ADJ}$ of the phase-control signal at the control midpoint $N_{MID}$ to generate the second dimming curve 420. For example, the user may adjust the phase angle P from the original phase angle $P_{ORG}$ to an adjusted phase angle $P_{ADJ}$ (e.g., from inflection point 430 to inflection point 440) to generate the second dimming curve 420. The second dimming curve 420 may be characterized by the inflection point 440, which may be characterized by the adjusted phase angle $P_{ADJ}$ at the control midpoint $N_{MID}$.

The second dimming curve 420 may comprise a first portion and a second portion. The first portion of the second dimming curve 420 may begin at the minimum phase angle $P_{MIN}$ and end at the inflection point 440, and may have a first slope. The second portion of the second dimming curve 420 may begin at the inflection point 440 and end at the maximum phase angle $P_{MAX}$, and may have a second slope. The first slope may be different from the second slope, for example, the first slope may be less than the second slope (e.g., as shown in FIG. 4). The first slope may be a substantially constant slope and/or the second slope may be a substantially constant slope (e.g., as shown in FIG. 4). The first slope may have a non-constant slope and/or the second slope may have a non-constant slope.

If the first slope of the dimming curve is smaller than the second slope of the dimming curve, as shown by the second dimming curve 420, for example, then the user may have increased control or granularity with respect to dimming at the low end (e.g., close to the minimum phase angle $P_{MIN}$). For example, if the user reduces the phase angle P of the phase-control signal delivered to the lighting load at the control midpoint $N_{MID}$, then the rate of change of the phase angle P with respect to the controlled lighting intensity N may be smaller below the control midpoint $N_{MID}$ (e.g., between $N_{MIN}$ and $N_{MID}$) than above the control midpoint $N_{MID}$ (e.g., between $N_{MID}$ and $N_{MAX}$). For example, a single actuation of the power adjustment actuator may result in a smaller change of phase angle P when the controlled lighting intensity N is below the control midpoint $N_{MID}$ than when the controlled lighting intensity N is above the control midpoint $N_{MID}$. This may correspond to a smaller change in actual lighting intensity of the lighting load when the control lighting intensity N is below the control midpoint $N_{MID}$. This may provide for a more accurate control of the phase angle P of the phase-control signal (e.g., and the actual lighting intensity of the lighting load) near the minimum controlled lighting intensity $N_{MIN}$.

The control midpoint $N_{MID}$ may represent the middle point of a power adjustment actuator (e.g., power adjustment actuator 116/224) of the dimmer switch. For example, when the controlled lighting intensity N is at the control midpoint $N_{MID}$, an equal number of actuations of the intensity adjustment actuator may be required to adjust the phase angle P to either the minimum phase angle $P_{MIN}$ or the maximum phase angle $P_{MAX}$. The control midpoint $N_{MID}$ may represent a point at which the middle visual indicator of the linear array of visual indicators is illuminated. However, the control midpoint $N_{MID}$ may represent a point other than the middle point of a power adjustment actuator (e.g., power adjustment actuator 116/224) of the dimmer switch.

Figure 5:
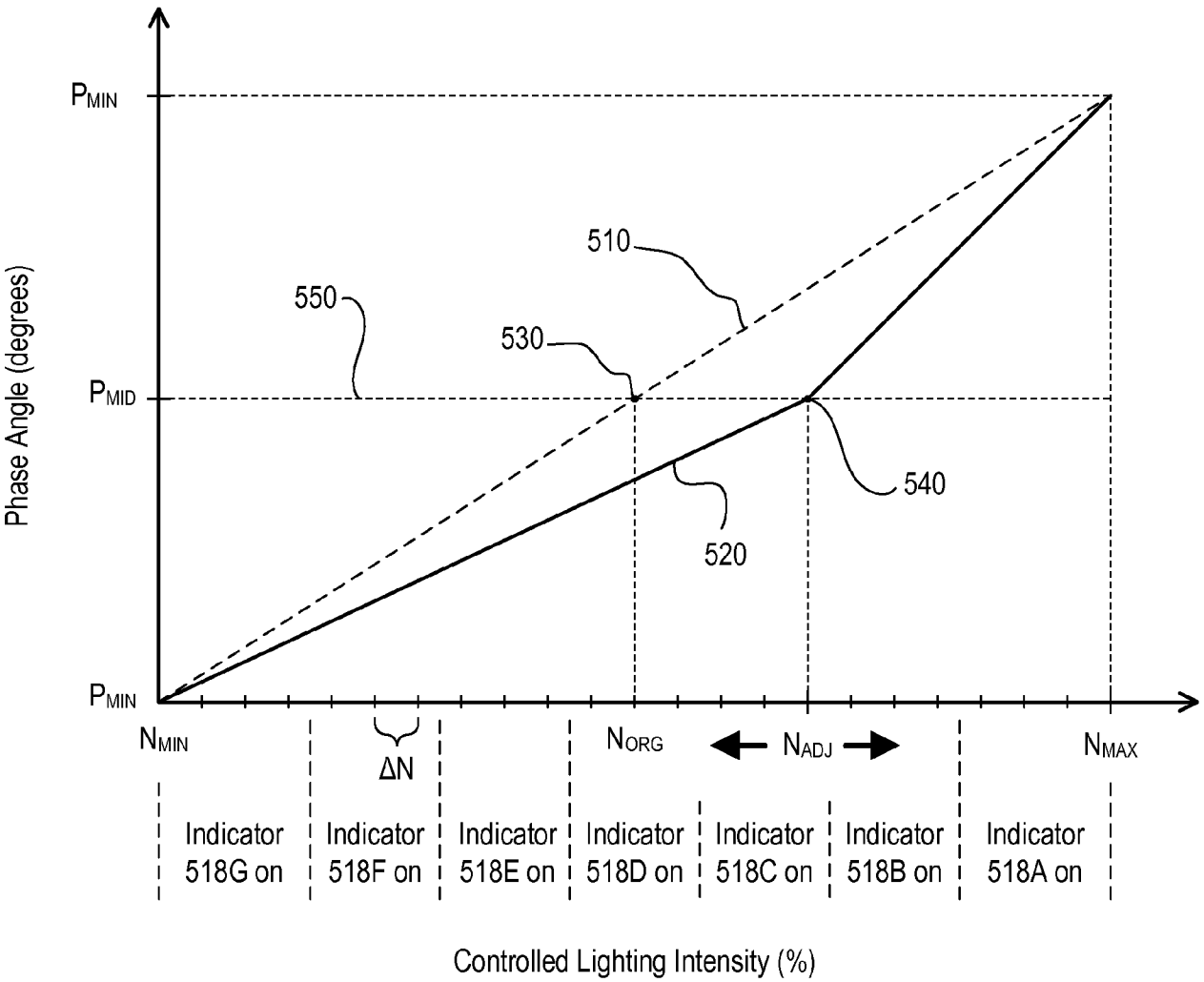
FIG. 5 is another example dimming curve of a phase angle of a phase-control signal with respect to a controlled lighting intensity of a dimmer switch.

FIG. 5 is another example dimming curve of a phase angle of a phase-control signal with respect to a controlled lighting intensity of a dimmer switch (e.g., dimmer switch 100, load control device 200, etc.). A user of a dimmer switch may generate a second dimming curve by adjusting a controlled lighting intensity $N_{ADJ}$ at a phase angle midpoint $P_{MID}$. This may be performed similarly as described with referenced to FIG. 4, except the phase angle midpoint $P_{MID}$ may be kept constant as the user adjusts the controlled lighting intensity $N_{ADJ}$ associated with the phase angle midpoint $P_{MID}$.

The dimmer switch may adjust the phase angle P of a phase-control signal delivered to the lighting load between a minimum phase angle $P_{MIN}$ and a maximum phase angle $P_{MAX}$. An intensity adjustment actuator (e.g., power adjustment actuator 116/224) of the dimmer switch may adjust a controlled lighting intensity N between a minimum controlled lighting intensity $N_{MIN}$ and a maximum controlled lighting intensity $N_{MAX}$, for example, by a predetermined increment ΔN. For example, a single actuation of an upper portion (e.g., upper portion 116A) or a lower portion (e.g., lower portion 116B) of the intensity adjustment actuator may increase or decrease, respectively, the controlled lighting intensity N of the lighting load by the predetermined increment ΔN. The intensity adjustment actuator may be operable to adjust the relationship between the controlled lighting intensity N and the phase angle P to adjust a dimming curve. The dimmer switch may comprise a control curve actuator that is operable to adjust the relationship between the controlled lighting intensity N and the phase angle P to adjust a dimming curve. The control curve actuator may be a physical device (e.g., a potentiometer) or software residing within the dimmer switch.

The controlled lighting intensity N may be representative of the position of the intensity adjustment actuator on the dimmer switch. For example, the intensity adjustment actuator may comprise an array of visual indicators 518A-518G (e.g., similar to 118A-118G as shown in FIG. 2) and the visual indicators may be illuminated in accordance with the position of the controlled lighting intensity N, for example, as shown in FIG. 5. However, the dimmer switch may not comprise the array of visual indicators 518A through 518G.

The user may adjust a dimming curve (e.g., dimming curve 510) by raising or lowering a magnitude of the controlled lighting intensity N that may correspond with a specific phase angle (e.g., the phase angle midpoint $P_{MID}$) of the phase-control signal delivered to the lighting load, for example, using an advanced programming mode. For example, while adjusting the controlled intensity level, the controlled lighting intensity N may change (e.g., increase or decrease), but the phase angle P of the phase-control signal may not change. By adjusting the dimming curve (e.g. dimming curve 510), the dimmer switch may generate a new dimming curve (e.g., dimming curve 520). The user may adjust the controlled lighting intensity N by actuating the intensity adjustment actuator or control curve actuator when in the advanced programming mode, for example. For example, the user may adjust the magnitude of the controlled lighting intensity N from an original controlled lighting intensity $N_{ORG}$, which may correspond to a phase angle midpoint $P_{MID}$ according to a dimming curve 510, to any controlled lighting intensity N between the minimum controlled lighting intensity $N_{MIN}$ and the maximum controlled lighting intensity $N_{MAX}$. The user may adjust the controlled lighting intensity N by the predetermined increment ΔN. For example, as shown in FIG. 5, the user may define the magnitude of the adjusted controlled lighting intensity $N_{ADJ}$ corresponding to the phase angle midpoint $P_{MID}$ to be any controlled lighting intensity along the horizontal line 550.

After adjusting the magnitude of the controlled lighting intensity N at the phase angle midpoint $P_{MID}$, the user may define an inflection point (e.g., inflection point 540). When the user has finished the adjustment of the magnitude of the controlled lighting intensity N, the user may exit the advanced programming mode. The dimmer switch may generate a resulting dimming curve 520 (e.g., an adjusted dimming curve or second dimming curve) using the adjusted magnitude of the controlled lighting intensity $N_{ADJ}$ at the phase angle midpoint $P_{MID}$ (e.g., using the defined inflection point 540).

The resulting dimming curve may be characterized by the inflection point (e.g., inflection point 540 in FIG. 5) defined by the selected magnitude of the controlled lighting intensity $N_{ADJ}$ at the phase angle midpoint $P_{MID}$. The dimmer switch, for example, a controller of the dimmer switch (e.g., controller 214), may generate an adjusted (or second) dimming curve using the defined inflection point. For example, the controller may scale (e.g., linearly scale) the dimming curve between the minimum controlled intensity level $N_{MIN}$ and the adjusted controlled intensity level $N_{ADJ}$ at the defined inflection point, and the controller may scale (e.g., linearly scale) the dimming curve between the adjusted controlled intensity level $N_{ADJ}$ and the maximum controlled lighting intensity $N_{MAX}$. Accordingly, the controller may control the phase angle P of the phase-control signal delivered to the lighting load in response to the controlled lighting intensity N according to a dimming curve characterized by the defined inflection point (e.g., dimming curve 520 characterized by inflection point 540).

Still referring to FIG. 5, the dimmer switch may comprise a first dimming curve 510, such as a default dimming curve, for example, of which may be stored in memory. The dimming switch may generate a second or adjusted dimming curve 520, for example, as described herein. After generation of the second dimming curve 520, the dimmer switch may store the second dimming curve 520 in memory. A user of the dimmer switch may generate the second dimming curve 520 by altering the shape of the first dimming curve 510. For example, a user may adjust a controlled lighting intensity magnitude $N_{ADJ}$ that corresponds with the phase angle midpoint $P_{MID}$ of the phase-control signal delivered to the lighting load, for example, via an advanced programming mode. The first dimming curve 510 may be characterized by an inflection point 530, which may be characterized by controlled lighting intensity $N_{ORG}$ at the phase angle midpoint $P_{MID}$. The user may define an adjusted controlled intensity level $N_{ADJ}$ at the phase angle midpoint $P_{MID}$ to generate the second dimming curve 520. For example, the user may adjust the controlled intensity level N from the original controlled intensity level $N_{ORG}$ to an adjusted controlled intensity level $N_{ADJ}$ (e.g., from inflection point 530 to inflection point 540) to generate the second dimming curve 520. The second dimming curve 520 may be characterized by the inflection point 540, which may be characterized by the adjusted controlled intensity level $N_{ADJ}$ at the phase angle midpoint $P_{MID}$.

The second dimming curve 520 may comprise a first portion and a second portion. The first portion of the second dimming curve 520 may begin at the minimum controlled lighting intensity $N_{MIN}$ and end at the inflection point 540, and may have a first slope. The second portion of the second dimming curve 520 may begin at the inflection point 540 and end at the maximum controlled lighting intensity $N_{MAX}$, and may have a second slope. The first slope may be different from the second slope, for example, the first slope may be smaller than the second slope (e.g., as shown in FIG. 5). The first slope may be a substantially constant slope and/or the second slope may be a substantially constant slope (e.g., as shown in FIG. 5). The first slope may have a non-constant slope and/or the second slope may have a non-constant slope.

The phase angle midpoint $P_{MID}$ may represent the middle point of the phase angle P between the minimum phase angle $P_{MIN}$ and the maximum phase angle $P_{MAX}$. For example, when the phase angle P is at the phase angle midpoint $P_{MID}$, the phase-control signal may be characterized by a phase angle that is 90°. For example, if delivered to a lighting load that is an incandescent lamp, then the phase-control signal with a phase angle of 90° may cause the lamp to generate 50% of its total intensity. However, the phase angle midpoint $P_{MID}$ may be equal to a phase angle other than 90°. For example, the phase angle midpoint $P_{MID}$ may not be the middle point between the minimum phase angle $P_{MIN}$ and the maximum phase angle $P_{MAX}$. The phase angle midpoint $P_{MID}$ may correspond with the midpoint of the power adjustment actuator (e.g., as with dimming cure 510), or may not correspond with the midpoint of the power adjustment actuator (e.g., as with dimming curve 520), for example, depending on the dimming curve utilized.

Figure 6:
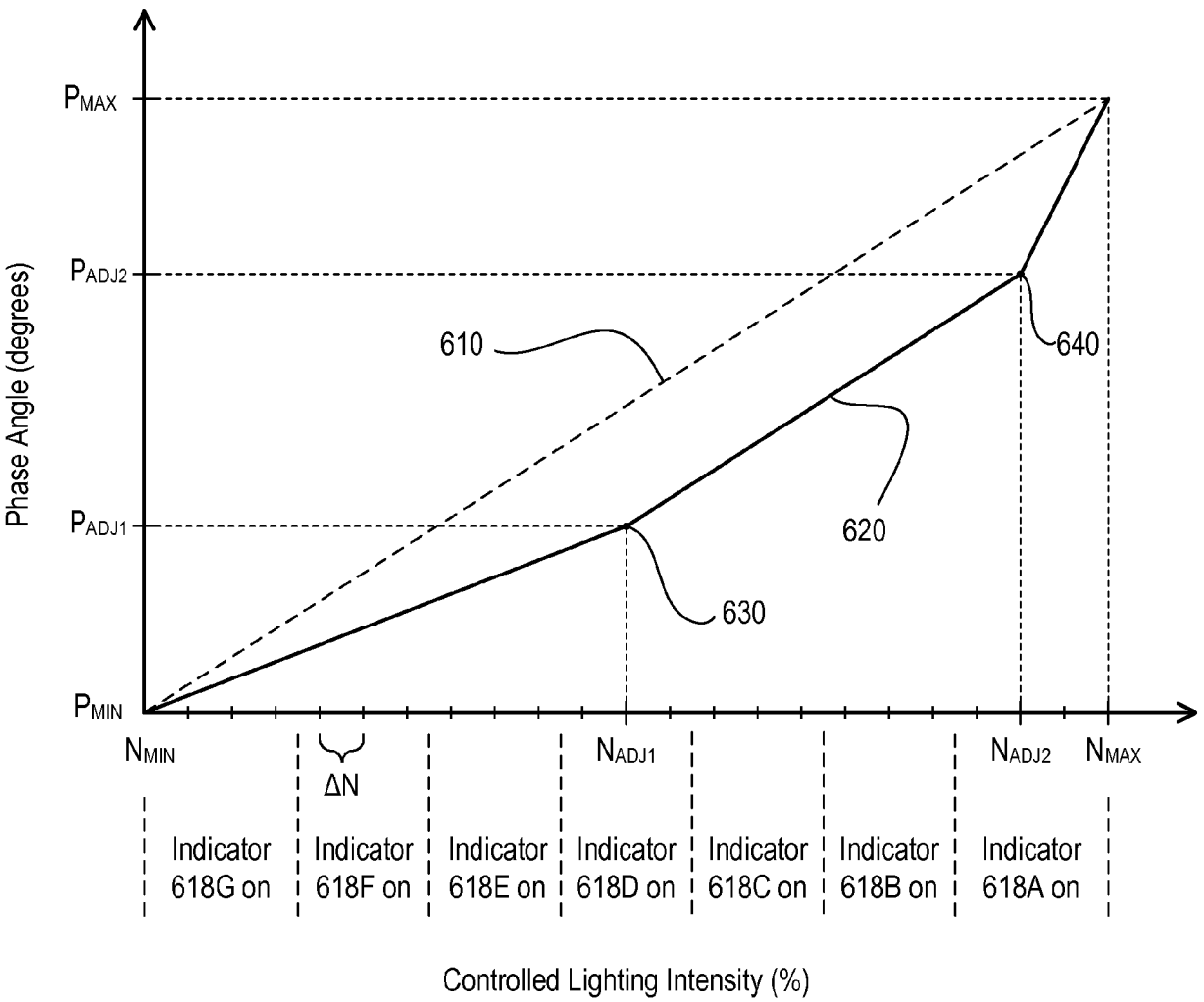
FIG. 6 is yet another example dimming curve of a phase angle of a phase-control signal with respect to a controlled lighting intensity of a dimmer switch.

FIG. 6 is yet another example dimming curve of a phase angle of a phase-control signal with respect to a controlled lighting intensity of a dimmer switch (e.g., dimmer switch 100, load control device 200, etc.). A user may define a plurality of inflection points of a dimming curve, for example, using an advanced programming mode. The user may define a plurality of inflection points, for example, as described with reference to FIG. 4 (e.g., by keeping the controlled lighting intensity N constant and adjusting the phase angle P) and/or as described with reference to FIG. 5 (e.g., by keeping the phase angle constant and adjusting the controlled lighting intensity N). After defining the plurality of inflection points, a dimmer switch (e.g., via a controller) may generate a dimming curve comprising the plurality of defined inflection points. After generating the dimming curve, the dimmer switch may store the dimming curve comprising the plurality of defined inflections points in memory. This may provide for a more customizable control of the range of the phase angle P (e.g., and in turn the light output of the load) across the range of the controlled lighting intensity N.

The dimmer switch may adjust the phase angle P of a phase-control signal delivered to the lighting load between a minimum phase angle $P_{MIN}$ and a maximum phase angle $P_{MAX}$. An intensity adjustment actuator (e.g., power adjustment actuator 116/224) or a control curve actuator of the dimmer switch may adjust a controlled lighting intensity N between a minimum controlled lighting intensity $N_{MIN}$ and a maximum controlled lighting intensity $N_{MAX}$, for example, by predetermined increments ΔN. For example, a single actuation of an upper portion (e.g., upper portion 116A) or a lower portion (e.g., lower portion 116B) of the intensity adjustment actuator may increase or decrease, respectively, the controlled lighting intensity N by a predetermined increment ΔN. The intensity adjustment actuator may be operable to adjust the controlled lighting intensity N and/or the phase angle P to adjust a dimming curve (e.g., to define an inflection point). The dimmer switch may comprise a control curve actuator that is operable to adjust the controlled lighting intensity N and/or the phase angle P to adjust a dimming curve (e.g., to define an inflection point). As described herein, the control curve actuator may be a physical device (e.g., a potentiometer) or software residing within the dimmer switch.

The controlled lighting intensity N may be representative of the position of the intensity adjustment actuator on the dimmer switch. For example, the intensity adjustment actuator may comprise an array of visual indicators 618A-618G (e.g., similar to 118A-118G as shown in FIG. 2) and the visual indicators may be illuminated in accordance with the position of the controlled lighting intensity N, for example, as shown in FIG. 6. However, the dimmer switch may not comprise the array of visual indicators 618A through 618G.

The dimmer switch may comprise a first dimming curve 610, such as a default dimming curve, for example. The user may adjust the phase angle P (e.g., to $P_{ADJ1}$ and $P_{ADJ2}$) at specific controlled lighting intensities (e.g., at $N_{ADJ1}$ and $N_{ADJ2}$, respectively) and/or adjust the magnitude of the controlled lighting intensity N (e.g., to $N_{ADJ1}$ and $N_{ADJ2}$) at specific phase angles P (e.g., at $P_{ADJ1}$ and $P_{ADJ2}$, respectively) to define one or more inflection points (e.g., inflection points 630, 640), for example, as described with reference to FIG. 4 and/or FIG. 5. The dimming switch may utilize the one or more inflection points to generate an adjusted dimming curve (e.g., second dimming curve 620).

The dimmer switch may define a plurality of inflection points, for example, as described herein. Although two inflection points 630, 640 are provided in FIG. 6, any number of inflection points may be defined. Inflection point 630 may be characterized by a phase angle $P_{ADJ1}$ of the phase-control signal corresponding to a magnitude $N_{ADJ1}$ of the controlled lighting intensity N. Similarly, inflection point 640 may be characterized by a phase angle $P_{ADJ2}$ of the phase-control signal corresponding to a magnitude $N_{ADJ2}$ of the controlled lighting intensity N. The dimming switch may define inflection points 630, 640 to create the second dimming curve 620, for example, as described with reference to FIG. 4 and/or FIG. 5.

The second dimming curve 620 may be characterized by inflection point 630 and inflection point 640. The second dimming curve 620 may comprise a first portion, a second portion, and a third portion. The first portion of the second dimming curve 620 may begin at the minimum phase angle $P_{MIN}$ and end at the inflection point 630, and may have a first slope. The second portion of the second dimming curve 620 may begin at the inflection point 630 and end at the inflection point 640, and may have a second slope. The third portion of the second dimming curve 620 may begin at the inflection point 640 and end at the maximum phase angle $P_{MAX}$, and may have a third slope. The first slope, the second slope, and/or the third slope may be different. For example, the first slope may be smaller than the second slope, which may be smaller than the third slope (e.g., as shown in FIG. 6). The first slope may be a substantially constant slope, the second slope may be a substantially constant slope, and/or the third slope may be a substantially constant slope (e.g., as shown in FIG. 6). The first slope may have a non-constant slope, the second slope may have a non-constant slope, and/or the third slope may have a non-constant slope.

A dimmer switch (e.g., dimmer switch 100, load control device 200, etc.) may be responsive to an advanced computing device (e.g., a personal computer (PC), a tablet, a smartphone, etc.) so that the shape of the dimming curve may be adjusted using the advanced computing device, for example, to create a dimming curve that comprises two or more portions with two or more different slopes (e.g., as described with reference to FIG. 4, FIG. 5, and/or FIG. 6).

A dimmer switch (e.g., dimmer switch 100, load control device 200, etc.) may comprise a plurality of predetermined non-linear dimming curves (e.g., second dimming curve 420/520/620) stored in memory. A user may select one a plurality of predetermined non-linear dimming curves, for example, using an advanced programming mode, for use during operation of the dimmer switch.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A load control device for controlling an amount of power delivered from an alternating current (AC) power source to an electrical load, said load control device comprising:

a controllably conductive device operable to control the amount of power delivered from the AC power source to the electrical load; and a controller operable to render the controllably conductive device conductive for at least a portion of a half-cycle of an AC line voltage from the AC power source in accordance with a first control curve and in accordance with a second control curve;

wherein the second control curve comprises a first portion having a first slope, a second portion having a second slope, and a third portion having a third slope, the first slope being different from the second slope, and the third slope being different from the first slope and the second slope.

2. The load control device of claim 1, further comprising:

a power adjustment actuator;

wherein the controller is operable to determine a controlled power level in response to user actuation of the power adjustment actuator and render the controllably conductive device conductive for at least the portion of the half-cycle of the AC line voltage from the AC power source in accordance with the controlled power level; and wherein the controller is operable to generate the second control curve in response to user actuation of the power adjustment actuator.

3. The load control device of claim 2, wherein the controller is operable to control the controllably conductive device to render the controllably conductive device conductive for at least the portion of the half-cycle of the AC line voltage from the AC power source to generate a phase-control signal; and wherein the controller is operable to generate the second control curve in response to user actuation of the power adjustment actuation to adjust a phase angle of the phase-control signal at a first controlled power level from a first phase angle associated with the first control curve to a second phase angle associated with the second control curve.

4. The load control device of claim 2, wherein the controller is operable to render the controllably conductive device conductive for at least the portion of the half-cycle of the AC line voltage from the AC power source to generate a phase-control signal; and wherein the controller is operable to generate the second control curve in response to user actuation of the power adjustment actuator to adjust the controlled power level at a phase angle of the phase-control signal level from a first controlled power level associated with the first control curve to a second controlled power level associated with the second control curve.

5. The load control device of claim 1, wherein the first slope of the second control curve is a substantially constant slope and the second slope of the second control curve is a substantially constant slope.

6. The load control device of claim 1, wherein at least one of the first slope and the second slope of the second control curve is a non-constant slope.

7. The load control device of claim 1, wherein the controllably conductive device is a bidirectional semiconductor switch.

8. The load control device of claim 1, wherein the load control device is an electronic dimmer, the electrical load is a lighting load, the first control curve is a first dimming curve, and the second control curve is a second dimming curve.

9. A load control device for controlling an amount of power delivered from an alternating current (AC) power source to an electrical load said load control device comprising:

a controllably conductive device operable to control the amount of power delivered from the AC power source to the electrical load;

a power adjustment actuator; and a controller operable to:

control the controllably conductive device to generate a phase-control signal characterized by a phase angle representative of the amount of power delivered to the electrical load;

determine a controlled power level for the electrical load in response to user actuation of the power adjustment actuator;

adjust the phase-angle of the phase-control signal to adjust the amount of power delivered to the electrical load in response to the controlled power level as defined by a first control curve or a second control curve; and generate the second control curve in response to user actuation of the power adjustment actuator by adjusting the phase angle of the phase-control signal at a particular controlled power level from a first phase angle to a second phase angle to define an inflection point at a junction between a first portion and a second portion of the second control curve, the first portion having a first slope and the second portion having a second slope, the first slope being different from the second slope.

10. The load control device of claim 9, wherein the first slope of the second control curve is a substantially constant slope and the second slope of the second control curve is a substantially constant slope.

11. The load control device of claim 9, wherein at least one of the first slope and the second slope of the second control curve is a non-constant slope.

12. The load control device of claim 9, wherein the controller is operable to generate the second control curve when the load control device is in an advanced programming mode.

13. The load control device of claim 9, further comprising memory, wherein the controller is operable to store the first dimming curve and the second dimming in the memory.

14. The load control device of claim 9, further comprising a plurality of visual indicators, wherein the load is a lighting load, and wherein one or more of the visual indicators is illuminated to indicate the particular controlled power level during generation of the second control curve.

15. A load control device for controlling an amount of power delivered from an alternating current (AC) power source to an electrical load, said load control device comprising:

a controllably conductive device operable to generate a phase-control signal to control the amount of power delivered from the AC power source to the electrical load, the amount of power delivered to the electrical load determined by a phase angle of the phase-control signal;

a power adjustment actuator; and a controller operable to:

determine a controlled power level for the electrical load in response to user actuation of the power adjustment actuator, the controlled power level configurable between a minimum controlled power level and a maximum controlled power level as defined by a first control curve or a second control curve; and control the controllably conductive device to generate the phase-control signal in accordance with the controlled power level and provide the phase-control signal to the electrical load;

wherein the controller is further operable to generate the second control curve by adjusting the phase angle of the phase-control signal at a first controlled power level from a first phase angle to a second phase angle and adjusting the phase angle of the phase-control signal at a second controlled power level from a third phase angle to a fourth phase angle, the second control curve comprising a first portion having a first slope, a second portion having a second slope, and a third portion having a third slope, the first slope being different from the second slope, and the third slope being different from the first slope and the second slope.

16. The load control device of claim 15, further comprising memory, wherein the controller is operable to store the second control curve in the memory.

17. The load control device of claim 15, wherein the controller is operable to adjust the phase angle of the phase-control signal at the first controlled power level from the first phase angle to the second phase angle in response to the power adjustment actuator.

18. The load control device of claim 15, wherein the load control device comprises a control curve actuator, and the controller is operable to adjust the phase angle of the phase-control signal at the first controlled power level from the first phase angle to the second phase angle in response to user actuation of the control curve actuator.

19. The load control device of claim 15, wherein the load control device is an electronic dimmer, the load is a lighting load, the first control curve is a first dimming curve, and the second control curve is a second dimming curve.

20. The load control device of claim 15, further comprising an array of visual indicators, the controller configured to control the array of visual indicators to provide feedback relating to the adjustment of the phase angle of the phase-control signal at a first controlled power level.

21. The load control device of claim 15, wherein the first portion of the second control curve begins at the minimum controlled power level and ends at the first controlled power level and the second portion of the second control curve begins at the first controlled power level and ends at the maximum controlled power level.

22. The load control device of claim 21, wherein the first slope is smaller than the second slope.

23. The load control device of claim 15, wherein the first slope is a substantially constant slope and the second slope is a substantially constant slope.

24. The load control device of claim 15, wherein at least one of the first slope and the second slope is a non-constant slope.

25. The load control device of claim 15, wherein the first portion of the second control curve begins at the minimum controlled power level and ends at the first controlled power level, the second portion of the second control curve begins at the first controlled power level and ends at the second controlled power level, and the third portion of the second control curve begins at the second controlled power level and ends at the maximum controlled power level.

26. The load control device of claim 25, wherein the first slope is smaller than the second slope, and the second slope is smaller than the third slope.

27. The load control device of claim 15, wherein the first control curve is characterized by the first phase angle at the first controlled power level and the third phase angle at the second controlled power level, and wherein the second control curve is characterized by the second phase angle at the first controlled power level and the fourth phase angle at the second controlled power level.

28. The load control device of claim 15, wherein the controller is operable to control the amount of power delivered to the electrical load to control an actual lighting intensity of the electrical load between a minimum actual lighting intensity to a maximum actual lighting intensity, and to configure the controlled lighting intensity between a minimum controlled lighting intensity and a maximum controlled lighting intensity.

29. A method for controlling an amount of power delivered from an alternating current (AC) power source to an electrical load, said method comprising:

controlling the amount of power delivered from the AC power source to the electrical load for at least a portion of a half-cycle of an AC line voltage from the AC power source in accordance with a first control curve; and controlling the amount of power delivered from the AC power source to the electrical load for at least a portion of a half-cycle of an AC line voltage from the AC power source in accordance with a second control curve;

wherein the second control curve comprises a first portion having a first slope, a second portion having a second slope, and a third portion having a third slope, the first slope being different from the second slope, and the third slope being different from the first slope and the second slope.

30. The method of claim 29, further comprising:

generating the second control curve in response to user actuation of a power adjustment actuator.

31. The method of claim 30, further comprising:

setting a controlled power level in response to user actuation of the power adjustment actuator;

determining the amount of power delivered from the AC power source to the electrical load according to the controlled power level.

32. The method of claim 30, wherein rendering the controllably conductive device conductive for at least the portion of the half-cycle of the AC line voltage from the AC power source is performed to generate a phase-control signal, the method further comprising:

generating the second control curve in response to user actuation of the power adjustment actuator to adjust of a phase angle of the phase-control signal at a first controlled power level from a first phase angle associated with the first control curve to a second phase angle associated with the second control curve.

33. The load control device of claim 30, wherein rendering the controllably conductive device conductive for at least the portion of the half-cycle of the AC line voltage from the AC power source is performed to generate a phase-control signal, the method further comprising:

generating the second control curve in response to user actuation of the power adjustment actuator to adjust of the controlled power level at a phase angle of the phase-control signal level from a first controlled power level associated with the first control curve to a second controlled power level associated with the second control curve.

34. The method of claim 29, wherein the first slope of the second control curve is a substantially constant slope and the second slope of the second control curve is a substantially constant slope.

35. The method of claim 29, wherein at least one of the first slope and the second slope of the second control curve is a non-constant slope.

36. The method of claim 29, wherein the first control curve is a first dimming curve and the second control curve is a second dimming curve.

37. A method for controlling an amount of power delivered from an alternating current (AC) power source to an electrical load, said method comprising:

setting a controlled power level via an power adjustment actuator;

generating a phase-control signal characterized by a phase angle representative of the amount of power delivered to the electrical load;

adjusting the phase angle of the phase-control signal to adjust the amount of power delivered to the electrical load in response to the controlled power level as defined by a first control curve or a second control curve; and generating the second control curve in response to user actuation of the power adjustment actuator by adjusting the phase angle of the phase-control signal at a particular controlled power level from a first phase angle to a second phase angle to define an inflection point at a junction between a first portion and a second portion of the second control curve, the first portion having a first slope and the second portion having a second slope, the first slope being different from the second slope.

38. The method of claim 37, wherein the first slope of the second control curve is a substantially constant slope and the second slope of the second control curve is a substantially constant slope.

39. The method of claim 37, wherein at least one of the first slope and the second slope of the second control curve is a non-constant slope.

40. The method of claim 37, further comprising:

setting the load control device in an advanced programming mode prior to generating the second control curve.

41. The method of claim 37, further comprising:

defining an inflection point characterized by the second phase angle at the first controlled power level; and generating the second control curve utilizing the inflection point.

42. The method of claim 37, further comprising:

storing the first control curve and the second control curve in memory.

43. A method for controlling an amount of power delivered from an alternating current (AC) power source to an electrical load, said method comprising:

setting a controlled power level, the controlled power level configurable between a minimum controlled power level and a maximum controlled power level as defined by a first control curve, a phase angle of a phase-control signal determined by the controlled power level;

providing the phase-control signal to the electrical load, the amount of power delivered from the AC power source to the electrical load determined by the phase angle of the phase-control signal; and generating a second control curve by adjusting the phase angle of the phase-control signal at a first controlled power level from a first phase angle to a second phase angle and adjusting the phase angle of the phase-control signal at a second controlled power level from a third phase angle to a fourth phase angle, the second control curve comprising a first portion having a first slope, a second portion having a second slope, and a third portion having a third slope, the first slope being different from the second slope, and the third slope being different from the first slope and the second slope.

44. The method of claim 43, further comprising storing the second control curve in memory of the load control device.

45. The method of claim 43, wherein setting the controlled power level is performed in response to user actuation of a power adjustment actuator, and wherein generating the second control curve is performed in response to user actuation of the power adjustment actuator.

46. The method of claim 43, wherein the first control curve is a first dimming curve and the second control curve is a second dimming curve.

47. The method of claim 43, further comprising:

providing feedback relating to adjusting the phase angle of the phase-control signal at the first controlled power level via an array of visual indicators.

48. The method of claim 43, wherein the first portion of the second control curve begins at the minimum controlled power level and ends at the first controlled power level and the second portion of the second control curve begins at the first controlled power level and ends at the maximum controlled power level.

49. The method of claim 48, wherein the first slope is smaller than the second slope.

50. The method of claim 43, wherein the first slope is a substantially constant slope and the second slope is a substantially constant slope.

51. The method of claim 43, wherein at least one of the first slope and the second slope is a non-constant slope.

52. The method of claim 43, wherein the first portion of the second control curve begins at the minimum controlled power level and ends at the first controlled power level, the second portion of the second control curve begins at the first controlled power level and ends at the second controlled power level, and the third portion of the second control curve begins at the second controlled power level and ends at the maximum controlled power level.

53. The method of claim 52, wherein the first slope is smaller than the second slope, and the second slope is smaller than the third slope.

54. The method of claim 43, wherein the first control curve is characterized by the first phase angle at the first controlled power level and the third phase angle at the second controlled power level, and wherein the second control curve is characterized by the second phase angle at the first controlled power level and the fourth phase angle at the second controlled power level.

* * * * *